US007211767B1

(12) United States Patent
Dariavach et al.

(10) Patent No.: US 7,211,767 B1
(45) Date of Patent: May 1, 2007

(54) TECHNIQUES FOR TREATING A SURFACE CRACK ON A COMPONENT

(75) Inventors: Nader G. Dariavach, Upton, MA (US); James A. Rice, Waukesha, WI (US)

(73) Assignee: EMC Corporation, Hopkinton, MA (US)

( * ) Notice: Subject to any disclaimer, the term of this patent is extended or adjusted under 35 U.S.C. 154(b) by 102 days.

(21) Appl. No.: 11/022,999

(22) Filed: Dec. 27, 2004

(51) Int. Cl.
*H05B 1/00* (2006.01)

(52) U.S. Cl. ..... 219/162; 219/50

(58) Field of Classification Search ..... 219/50, 219/162

See application file for complete search history.

(56) References Cited

U.S. PATENT DOCUMENTS 531,197 A * 12/1894 Lemp ..... 219/50
4,307,280 A * 12/1981 Ecer ..... 219/76.1
6,489,584 B1 * 12/2002 Kelly ..... 219/121.46

OTHER PUBLICATIONS

Nader G. Dariavach, "The Effect of High Density Electric Pulses on Sintered Aluminum 201AB SiC MMC PM Compacts During Plastic Deformation", Oct. 2002, pp. 1-176.
Nader G. Dariavach and James A. Rice, "Electromigration and the Electroplastic Effect in Aluminum SiC MMCs", May 2000, pp. 40-42.

* cited by examiner

*Primary Examiner*—Clifford C. Shaw
(74) *Attorney, Agent, or Firm*—Bainwood Huang

(57) ABSTRACT

A system is configured to treat a conductive component. The system includes a power source, an interface configured to electrically contact with a surface of the conductive component, and a controller coupled to the power source and the interface. The controller is configured to pass electric current (e.g., electric pulses) from the power source through the interface and the component to melt tips of a set of cracks along the surface of the component. As the current passes around the set of cracks, the current generates localized heating in high-resistance dislocations at the crack tips to repair the cracks. Accordingly, such current heals the cracks and inhibits the cracks from spreading. Furthermore, the effect of the current remains localized thus enabling the current to strengthen the material around the cracks while easily avoiding damaging or weakening other portions of the component.

23 Claims, 6 Drawing Sheets

TECHNIQUES FOR TREATING A SURFACE CRACK ON A COMPONENT

BACKGROUND

Surface cracks in materials pose reliability concerns in a broad range of industries. For example, in the aircraft industry, a weak point on an aircraft wing flap may begin as a micro-crack which is virtually undetectably by the naked eye. Over time, the micro-crack may grow due to stresses from normal use. In particular, the ends of the crack expand outwardly, and the tip of the crack (i.e., the deep point of the crack) extends even deeper. Eventually, the micro-crack grows into a larger visible crack which is hopefully detected and fixed before a failure results.

One conventional approach to fixing a surface crack in a part (e.g., tiny cracks on aircraft components such as propulsion system plumbing) is to repair the crack by welding. In this approach, welding equipment fuses the two sides of the crack back together. In particular, the welding equipment applies extreme heat to make the area around the crack soft and pasty so that the material along the two sides of the crack melts back together again. In some situations, additional metallic material fuses into or above the crack to provide reinforcement.

Another conventional approach to fixing a surface crack in a part is to drill holes into the part at the ends of the crack. Such drilling rounds out the crack ends thus preventing the crack the growing outwardly any further.

Yet another conventional approach to fixing a surface crack in a part is to simply replace the part. For example, in the context of a wing flap, a team of mechanics simply removes the failed wing flap and installs a new wing flap in its place.

SUMMARY

Unfortunately, there are deficiencies to the above-described conventional approaches to fixing a part having a surface crack. For example, in the above-described conventional welding approach, the welding operation is capable of damaging the part and thus introducing weak points in other locations. In particular, the welding process often involves the application of extreme heat which not only provides desired fusing, but also provides weakening in neighboring areas of the heat-affected zone due to distortion and welding stresses. Also, due to the extreme heat, the welding process is not appropriate for fixing many types of materials such as silicon-based components.

Additionally, in connection with the above-described conventional hole drilling approach, the drilling of holes simply prevents the crack from spreading. This process does not strengthen the part. Rather, if anything, this process weakens the part by removing additional material from the part.

Furthermore, in connection with the above-described conventional part replacement approach, part replacement is very expensive. In effect, significant expense are incurred because the cost of the new part is incurred, as well as the cost to remove the cracked part and install the new part. Moreover, the possibility exists that removal of the cracked part and installation of the new part will cause damage to another part in the vicinity, e.g., fatigue in adjacent supporting structures that are overstressed during the removal and/or installation processes.

In contrast to the above-described conventional approaches to fixing a surface crack in a part, there is a component treatment system which is capable of utilizing electric current to repair a surface crack on a component (e.g., a conductive body). The electric current (e.g., a series of high-density, short electric pulses) is configured to melt tips of the crack (i.e., embedded narrow portions of the crack). Such current is capable of generating localized heating in high-resistance dislocations at the crack tips to repair the crack as the current passes from one side of the crack to the other. Accordingly, such current heals the crack and inhibits the crack from spreading. Furthermore, the effect of the current remains localized thus enabling the current to strengthen the material around the crack while easily avoiding damaging or weakening other portions of the component.

One embodiment is directed to a system for treating a conductive component. The system includes a power source, an interface configured to electrically contact with a surface of the conductive component, and a controller coupled to the power source and the interface. The controller is configured to pass electric current (e.g., electric pulses) from the power source through the interface and the component to melt tips of a set of cracks along the surface of the component.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

A component treatment system is capable of utilizing electric current to repair a surface crack on a component (e.g., a conductive body). The electric current (e.g., a series of high-density, short electric pulses) is configured to melt tips of the crack (i.e., embedded narrow portions of the crack). Such current is capable of generating localized heating in high-resistance dislocations at the crack tips to repair the crack as the current passes from one side of the crack to the other. Accordingly, such current heals the crack and inhibits the crack from spreading. Furthermore, the effect of the current remains localized thus enabling the current to strengthen the material around the crack while easily avoiding damaging or weakening other portions of the component.

Figure 1:
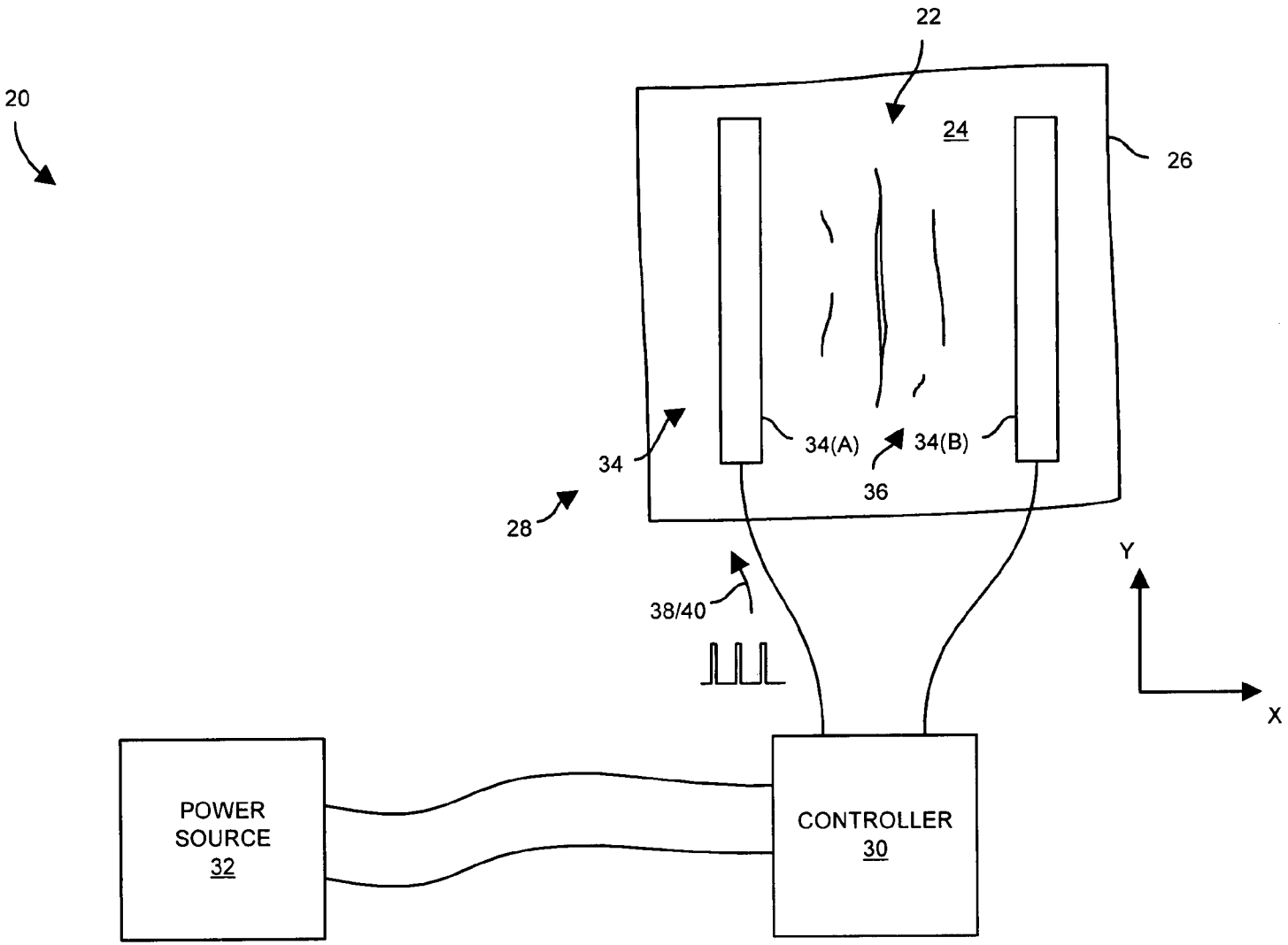
FIG. 1 is a perspective view of a system for treating a component with electric current.

FIG. 1 shows a component treatment system 20 which is suitable for treating a set of surface cracks 22 (i.e., one or more cracks 22) on a surface 24 of a conductive component 26 (e.g., a planar metallic part, a silicon-based part, etc.).

The component treatment system 20 includes a component interface 28, a controller 30 and a power source 32. The component interface 28 includes a pair of electrodes 34(A), 34(B) (collectively, electrodes 34) and an insulator 36 (shown only generally by the arrow 36) which is disposed between the electrodes 34. The controller 30 couples to the interface 28 and to the power source 32 (e.g., through a set of cables). Preferably, the power source 32 and the connecting media are capable of delivering a significant amount of current (e.g., well above 80 Amperes per square millimeter).

During operation of the component treatment system 20, the controller 30 is configured to take electric current 38 from the power source 32 and pass that current through the component interface 28 and the component 26 in response to commands from a user. In particular, the controller 30 is configured to send a series of high-density, short electric pulses 40 through the interface 28 and through the conductive component 26. This results in application of non-uniform Joule energy at a highly stressed area around the crack tip (i.e., the deepest portions of the surface cracks 22) where the highest dislocation density is present. Accordingly, there is significant heat release in these focused area only, resulting in localized melting and mending of the crack tips.

The electric current 38 flows from one electrode 34(A) to the other electrode 34(B) through the component 22. Preferably, the electric current 38 exceeds 80 Amperes/mm$^2$ in order to generate significant heating effects within the component interface 28. In some arrangements, the electrodes are substantially linear in shape and parallel to each other (e.g., 0.5 inches to 1.0 inches apart) to distribute the electric pulses 40 in a relatively uniform manner along the X-axis across the component surface 24. Due to such uniform distribution, the series of short electric pulses 40 provides effective localized heating down to a depth of about 2 millimeters. In some arrangements, the electric current 38 is direct current. In other arrangements, the electric current 38 is alternating current.

The insulator 36 of the component interface 28 (e.g., a rubber separator) is configured to inhibit the electric current 38 from arcing directly between the electrodes 38 and thus forcing the electric current 38 through the conductive component 26. As the electric pulses 40 pass through the component 26, the series of short electric pulses 40 generates localized heating at points of dislocations substantially at a depth of 2 millimeters or less within the component 26. In particular, the tips of the surface cracks 22 have higher resistances than at other portions of the component 26 due to defects in the crystalline structure of the material at the tips of the cracks 22. As a result, localized melting and repairing occurs at the crack tips thus strengthening the component 26. Moreover, since such heating is tightly focused at the points of dislocations only, there is no extreme heating of the bulk material and, thus, there is no weakening of other portions of the component 26 as in conventional approaches such as welding, drilling holes or part replacement. Further details will now be provided with reference to FIGS. 2 and 3.

Figure 2:
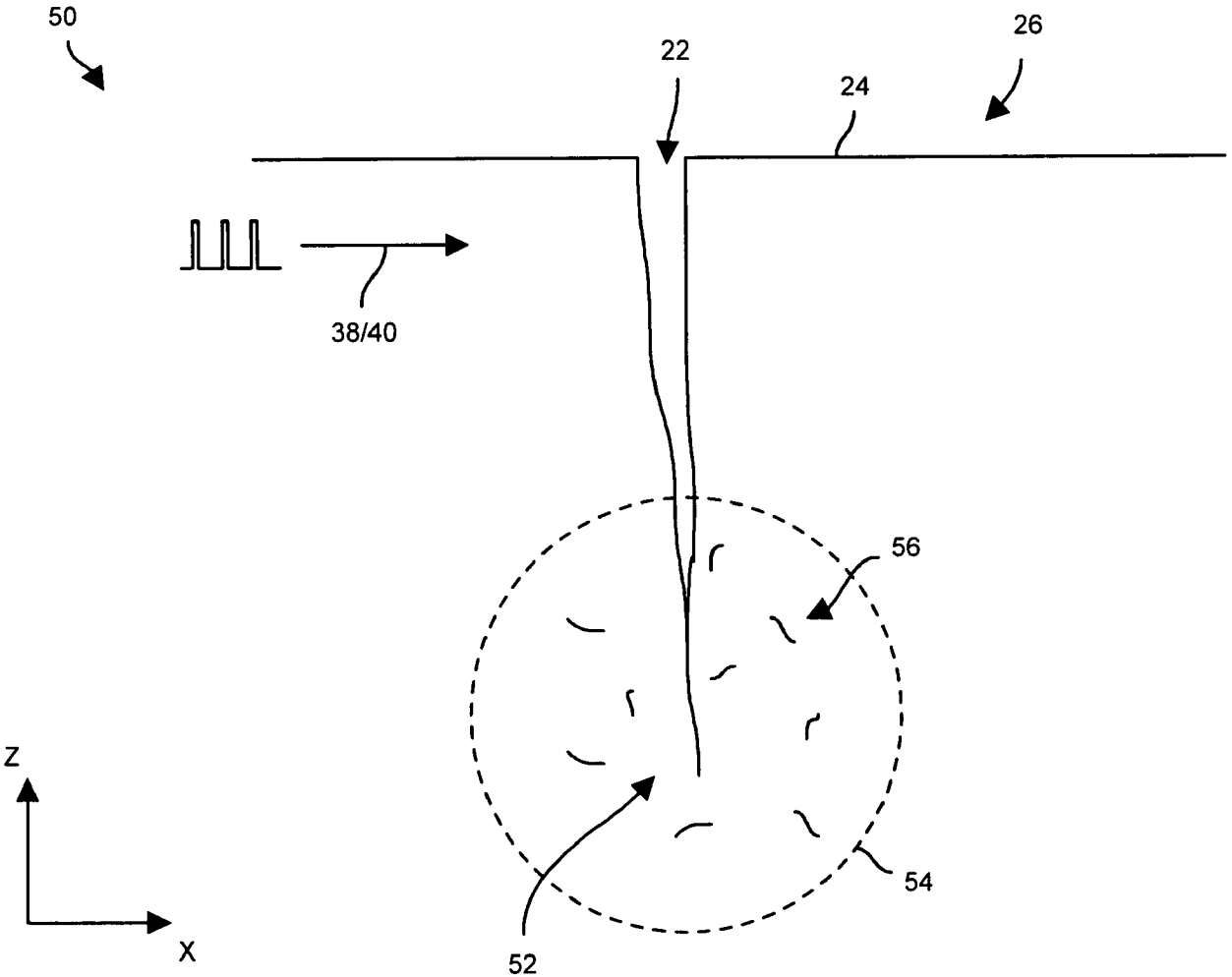
FIG. 2 is a cross-sectional view of a portion of the component as electric current passes around a surface crack.
Figure 3:
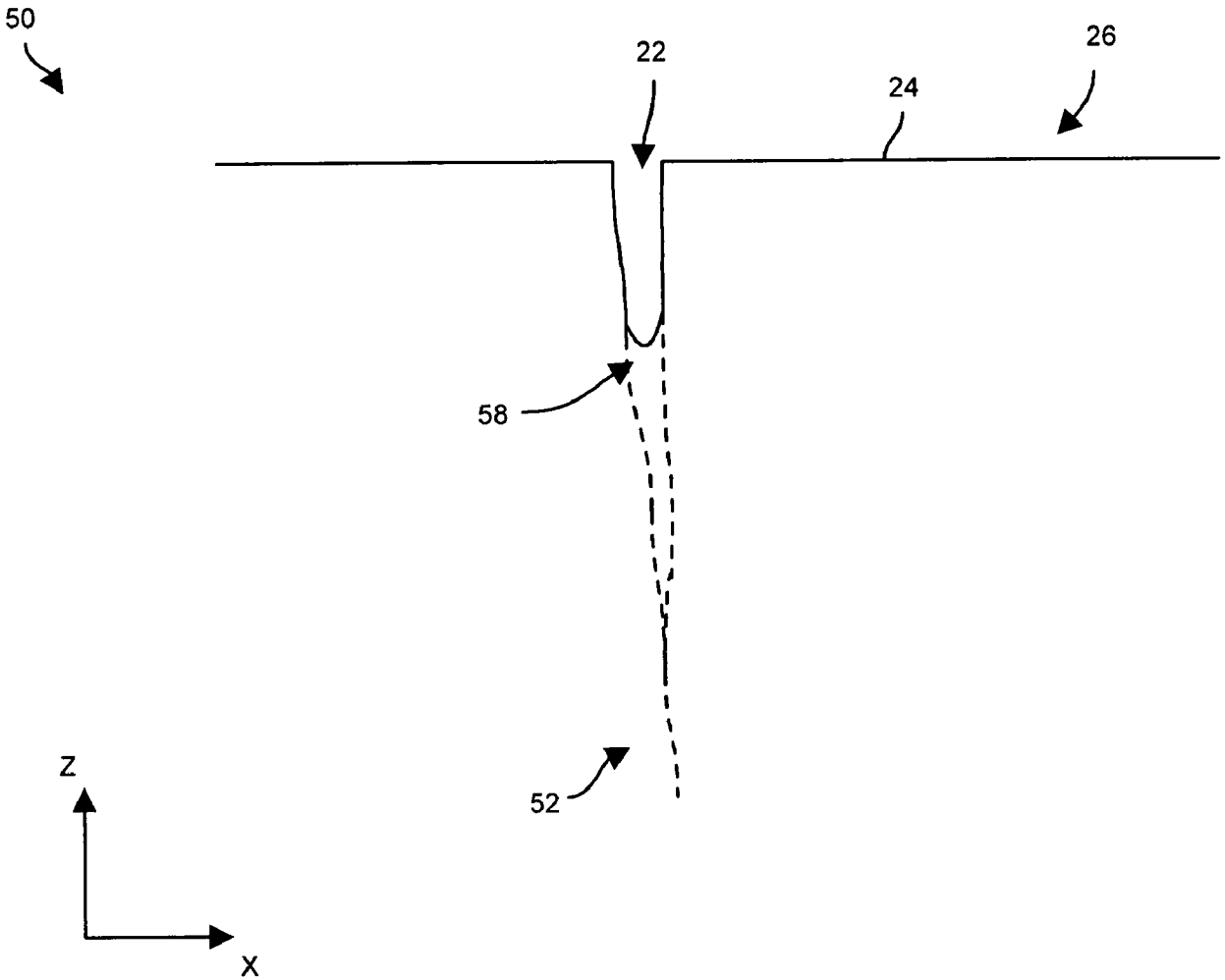
FIG. 3 is a subsequent cross-sectional view of the component after the electric current has passed around the surface crack for a period of time.

FIGS. 2 and 3 show a cross-sectional view of a portion 50 of the conductive component 26 at various stages of treatment by the component treatment system 20. In particular, FIG. 2 shows the portion 50 as the electric current 38 (i.e., a series of short electric pulses 40) passes through the component 26. FIG. 3 shows the portion 50 shortly after treatment (e.g., after a period of at most a few seconds of treatment has passed). As shown, the portion 50 includes a crack 22 having a tip 52 which extends in the negative Z-direction from the surface 24 of the component 26. An area 54 immediately around the crack tip 52 initially includes dislocations 56 (FIG. 2) due to breaks in the lattice of the material and thus has lower conductivity, i.e., higher resistance. That is, the area 54 has an extremely high density of dislocations 56 relative to other locations due to high plastic deformation and other stressing in that area 54.

As the electric current 38 passes through the component 26 during operation of the system 20, the area 54 tends to generate localized heating. In particular, at least some of the electric current 38 flows beneath the crack 22 from one side of the crack 22 to the other and through the area 54 causing tightly focused heating at the dislocations 56. Taking the skin effect into account, the amount of electric current 38 flowing beneath the crack 22 and through the tip 22, rather than around the crack 22 and along the surface 24, may vary depending on the orientation of the crack 22 relative to the angular orientation of the electrodes 34 (also see FIG. 1). Thus, the amount of electric current 38 is preferably set high enough (e.g., at least 80 Amperes/mm$^2$) to generate enough heat to cause melting at the crack tips 52 regardless of electrode orientation, but low enough so as not to cause melting of the bulk material. In some arrangements, the aggregate temperature rise in the bulk structure (i.e., the overall temperature of the component 26) remains small, or is negligible, during treatment.

As a result of the applied series of short electric pulses 40, there is little or no distortion or inadvertent work hardening in the component 26. Rather, only the area 54 immediately at the dislocations 56 tends to melt and thus repair itself. FIG. 3 illustrates a mended section 58 in place of the original tip 52 (shown in phantom in FIG. 3). Test data has shown situations in which up to 70% of a crack is repairable in this manner. Accordingly, the component 26 is now stronger and removal of the tip 52 inhibits further crack growth. Further details will now be provided with reference to FIG. 4.

Figure 4:
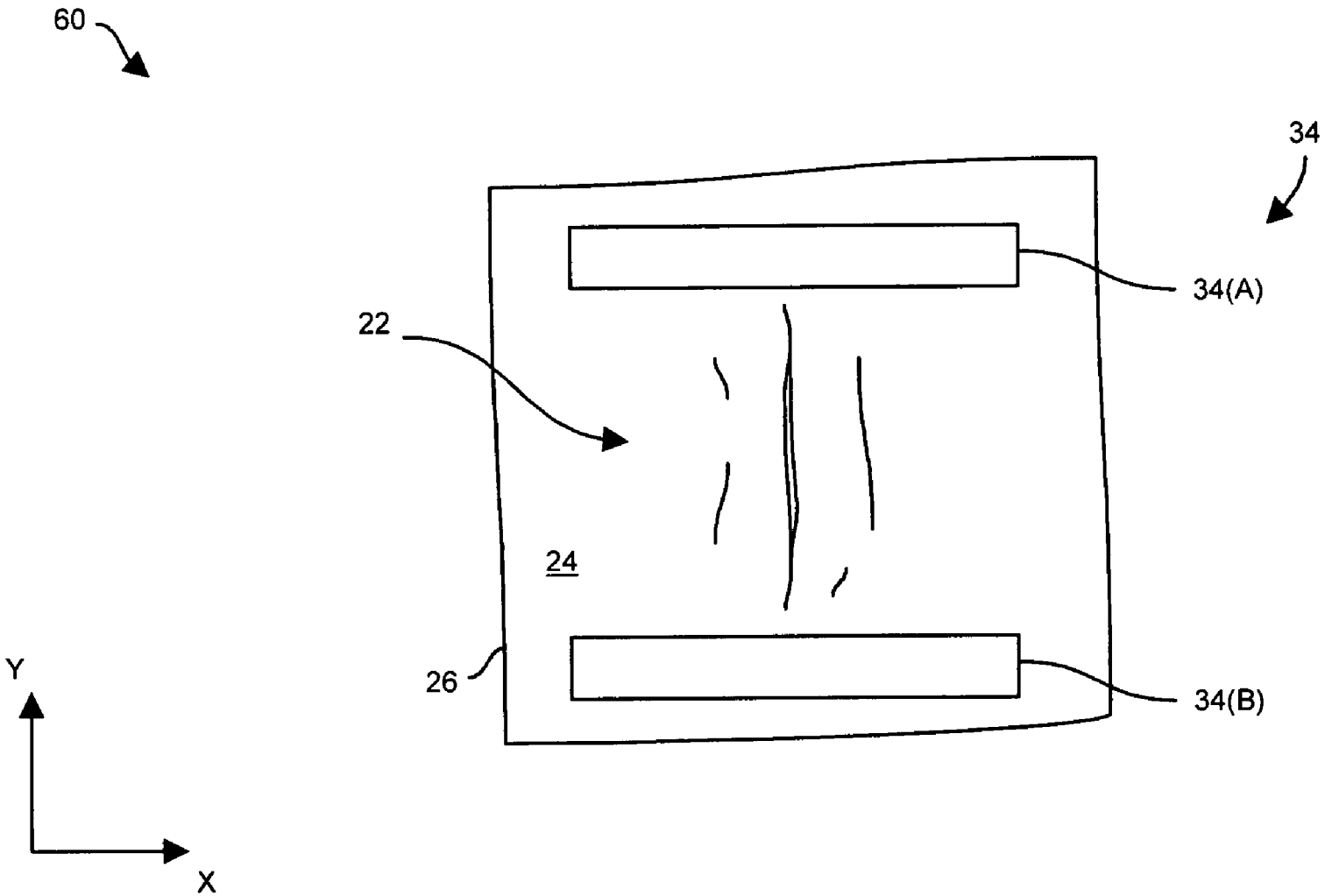
FIG. 4 is a top view of the portion of the component when an interface of the system of FIG. 1 is in contact with a surface of the component but at a different orientation.

FIG. 4 is a top view 60 of a portion of the component 26 when the component interface 28 of the system 20 is in contact with the surface 24 of the component 26. By way of example, the electrodes 34 are shown in a different orientation compared to that shown in FIG. 1. In one arrangement the area covered by the electrodes 34 is approximately 0.5 square inches.

It should be appreciated that, in some situations, a user has visually detected a crack 22 (e.g., due to the large size of the crack 22, due to magnification or X-ray sensing of the component 26, etc.). In these situations, the user may prefer to position the component interface 28 in the manner shown in FIG. 1. That is, the user orients the electrodes 34 to be substantially parallel to the majority of the cracks 22. Accordingly, the electric current 38 flows in a direction which is substantially perpendicular to the majority of the cracks 22 and a significant amount of the electric current 38 flows beneath the cracks 22 (i.e., along the X-axis in FIG. 1).

It should be further appreciated that, in some situations, the user is capable of omitting visual detection of the cracks, but nevertheless may wish to treat the component 26 (e.g., to remove any hidden defects, to treat the component 26 under the assumption that the component 26 may contain micro-cracks, etc.). In these situations, the user may position the component interface 28 as shown in FIG. 1, or alternatively as shown in FIG. 4 where the electrodes 34 are substantially perpendicular to the majority of the cracks 22 (or even perhaps diagonally). Of course, the user may purposefully position the interface 28 as shown in FIG. 4 for a particular desired effect as well (e.g., thorough and comprehensive application of the series of short electric pulses 40 in multiple directions such a first treatment in along the X-axis and a subsequent treatment along the Y-axis).

In FIG. 4, the electric current 38 flows along the Y-axis which is substantially parallel to the majority of cracks 22. Nevertheless, even in this situation, the electric current 38 repairs the tips 52 of the cracks 22 because the characteristics of the electric current 38, a series of electric pulses 40 with sufficient density/magnitude, results in melting of the crack tips 52 (FIGS. 2 and 3). Accordingly, it should be understood that the treatment process is capable of being applied for component strengthening whether cracks 22 have been initially detected or not. Further details will now be provided with reference to FIG. 5.

Figure 5:
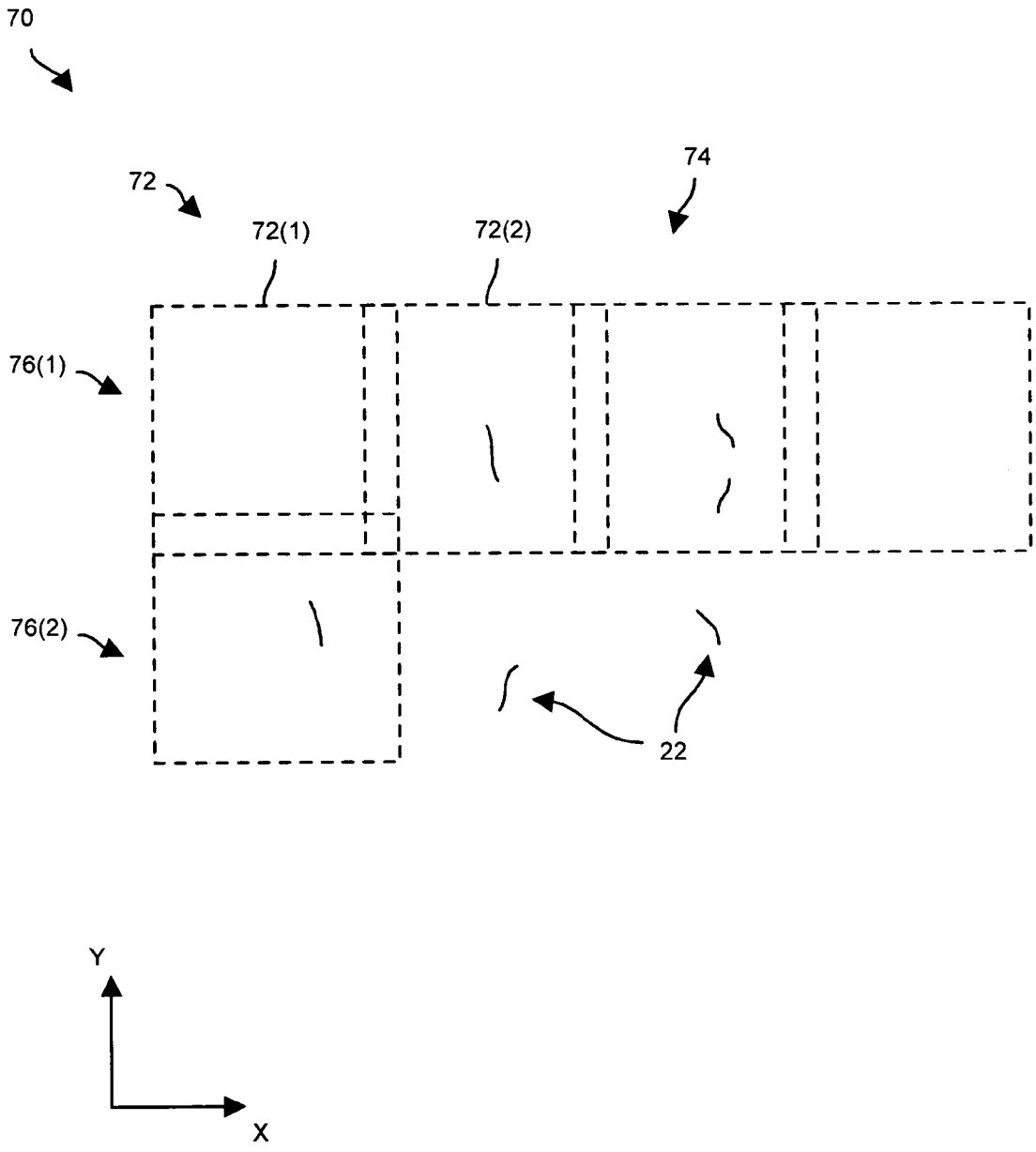
FIG. 5 is a top view of the component when multiple portions are treated in an organized and controlled manner.

FIG. 5 is a top view 70 of the component 26 when multiple portions 72 of the component surface 24 are treated in an organized and controlled manner (e.g., one portion at a time) to form a matrix coverage pattern 74 (e.g., in two dimensions). Here, the user places the component interface 28 over a first portion 72(1) and applies the electric current 38 through the first portion 72(1). In some arrangements, the series of short electric pulses 40 is provided for a duration of a few hundred milliseconds. The user then moves the component interface 28 over a second portion 72(2) and applies the electric current 38 in the same manner. The user repeats this process along a row 76(1) (i.e., the X-axis) and then repeats this process for another row 76(2), and so on. Since treatment of each portion 72 takes at most a few seconds, the user is ultimately capable of treating a relatively large surface area of the component 26 in a very short amount of time.

Preferably, the user partially overlaps sections 72 as shown in FIG. 5. Such overlapping provides a thorough and comprehensive treatment of the component 26 in total. Accordingly, any surface cracks 22 are repaired and further crack growth is inhibited. Further detail will now be provided with reference to FIG. 6.

Figure 6:
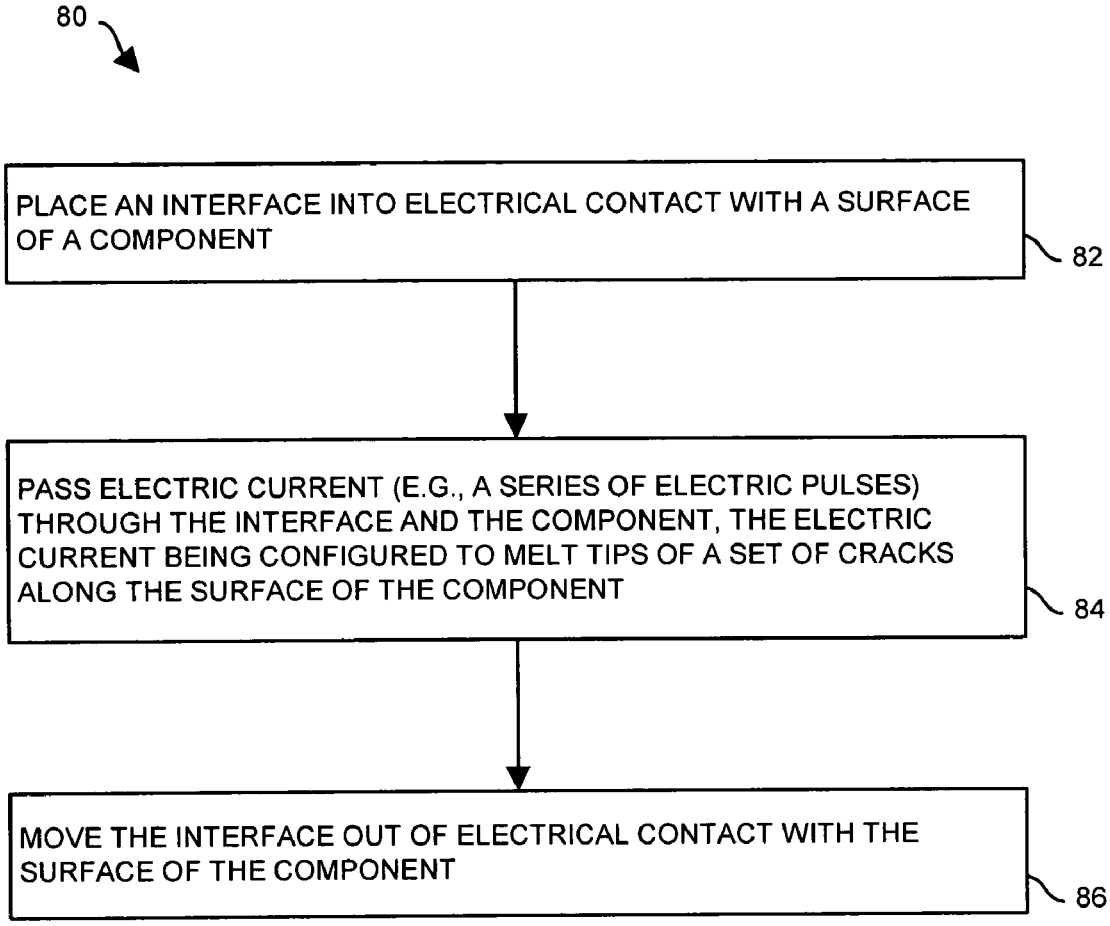
FIG. 6 is a flowchart of a procedure which is performed by a user of the system of FIG. 1.

FIG. 6 is a flowchart of a procedure 80 which is performed by a user (e.g., a person, automated equipment, etc.) using the component treatment system 20 when treating the conductive component 26. In step 82, the user places the component interface 28 into electrical contact with the surface 24 of the component 26 (also see FIG. 1).

In step 84, the user passes electric current 38 through the interface 28 and the component 26. As the electric current 38 flows through the component 26, the electric current melts tips of cracks 22 along the surface 24 of the component 26. Preferably, step 84 occurs under clean and controlled environmental conditions to ensure the electric current 38 robustly flows through the component 26 and no arcing occurs directly between the electrodes 34 of the interface 28.

In step 86, the user moves the interface 28 out of electrical contact with the surface 24 of the component 26. This may involve moving the interface 28 to another location 72 for further treatment of the component 26, or removal of the interface 28 from the component 26 completely if treatment is complete.

As described above, the component treatment system 20 is capable of utilizing electric current 38 to repair a surface crack 22 on a component 26 (e.g., a conductive body). The electric current 38 (e.g., a series of high-density, short electric pulses 40) is configured to melt tips 52 of the crack 22 (i.e., embedded narrow portions of the crack). Such current 38 is capable of generating localized heating in high-resistance dislocations 56 at the crack tips 52 to repair the crack 22 as the current 38 passes from one side of the crack to the other. Accordingly, such current 38 heals the crack 22 and inhibits the crack 22 from growing. Additionally, the effect of the current 38 remains localized thus enabling the current 38 to strengthen the material around the crack 22 while easily avoiding damaging or weakening other portions of the component 26.

While this invention has been particularly shown and described with references to preferred embodiments thereof, it will be understood by those skilled in the art that various changes in form and details may be made therein without departing from the spirit and scope of the invention as defined by the appended claims.

For example, it should be understood that an exemplary material for the component 26 is metal such as powder metal (PM) aluminum alloys. However, the component 26 is capable of being formed from other materials as well such as other metals (e.g., steel, etc.). Moreover, the material of the component 26 does not need to be metallic. Rather, the system 20 is capable of working on non-metallic conductive materials as well such as silicon-based materials.

What is claimed is:

1. A system for treating a conductive component, the system comprising:

a power source;

an interface configured to electrically connect with a surface of the conductive component; and a controller coupled to the power source and the interface, the controller being configured to pass electric current from the power source through the interface and the component to melt tips of a set of cracks along the surface of the component;

wherein the interface includes a first electrode configured to reside adjacent a first side of the set of cracks, and a second electrode configured to reside adjacent a second side of the set of cracks to direct the electric current from the first side of the set of cracks, beneath the set of cracks, to the second side of the set of cracks, to create localized melting of dislocations within the tips of the set of cracks;

wherein the controller, when passing the electric current through the interface and the component, is configured to:

apply, as the electric current, a series of electric pulses through the first and second electrodes of the interface.

2. The system of claim 1 wherein the controller, when applying the series of electric pulses, is configured to provide the series of electric pulses with electrical characteristics that generate focused heating and melting of material immediately adjacent crack tips at a depth of substantially 2 millimeters or less.

3. The system of claim 2 wherein each of the first and second electrodes is substantially linear in shape to apply the series of electric pulses in a substantially uniform manner beneath the set of cracks.

4. The system of claim 2 wherein the first electrode and the second electrode are configured to apply the series of electric pulses across an area of the surface of the component measuring substantially 0.5 square inches.

5. The system of claim 2 wherein the first electrode and the second electrode are disposed substantially parallel to each other; and wherein the interface includes an insulator which provides a non-conductive gap between the first electrode and the second electrode, the insulator having a width in a range of 0.5 inches to 1.0 inches.

6. The system of claim 1 wherein the controller, when applying the series of electric pulses, is configured to:

send at least 80 Amperes/mm$^2$ of electric current from the power source through the first and second electrodes of the interface and through the component.

7. The system of claim 1 wherein the power source includes a direct current (DC) circuit configured to output a DC signal in which current flows in a single direction; and wherein each electric pulse of the series of electric pulses involves current flow exclusively in the single direction from the DC circuit.

8. The system of claim 1 wherein the power source includes an alternating current (AC) circuit configured to output an AC signal in which current flows in a first direction and then a second direction; wherein each electric pulse of the series of electric pulses involves current flow in both the first direction and then the second direction from the AC circuit; and wherein the electric pulses of the series of electric pulses are separated by gaps of substantially zero current.

9. A method for treating a conductive component, the method comprising:

placing an interface into electrical contact with a surface of the component;

passing electric current through the interface and the component, the electric current being configured to melt tips of a set of cracks along the surface of the component; and moving the interface out of electrical contact with the surface of the component.

10. The method of claim 9 wherein the interface includes a first electrode and a second electrode; and wherein placing the interface into electrical contact with the surface of the component includes:

disposing the first electrode adjacent a first side of the set of cracks and the second electrode adjacent a second side of the set of cracks to direct the electric current from the first side of the set of cracks, beneath the set of cracks, to the second side of the set of cracks, to create localized melting of dislocations within the tips of the set of cracks.

11. The method of claim 10 wherein passing the electric current through the interface and the component includes:

applying, as the electric current, a series of electric pulses through the first and second electrodes of the interface.

12. The method of claim 11 wherein applying the series of electric pulses includes:

generating focused heating and melting of material immediately adjacent crack tips at a depth of substantially 2 millimeters or less.

13. The method of claim 12 wherein each of the first and second electrodes is substantially linear in shape to apply the series of electric pulses in a substantially uniform manner beneath the set of cracks.

14. The method of claim 13 wherein the first electrode and the second electrode are configured to apply the series of electric pulses across an area of the surface of the component measuring substantially 0.5 square inches.

15. The method of claim 13 wherein the first electrode and the second electrode are disposed substantially parallel to each other; and wherein the interface includes an insulator which provides a non-conductive gap between the first electrode and the second electrode, the insulator having a width in a range of 0.5 inches to 1.0 inches.

16. The method of claim 11 wherein applying the series of electric pulses includes:

sending at least 80 Amperes/mm$^2$ of electric current through the first and second electrodes of the interface and through the component.

17. The method of claim 11 wherein applying the series of electric pulses includes:

outputting, from a direct current (DC) circuit, a DC signal in which current flows in a single direction; and generating the series of electric pulses from the DC signal, each electric pulse of the series of electric pulses passing through the component with current flow exclusively in the single direction.

18. The method of claim 11 wherein applying the series of electric pulses includes:

outputting, from an alternating current (AC) circuit, an AC signal in which current flows in a first direction and then a second direction; and generating the series of electric pulses from the AC signal, each electric pulse of the series of electric pulses passing through the component with current flow in both the first direction and then the second direction from the AC circuit, and the electric pulses of the series of electric pulses being separated by gaps of substantially zero current.

19. The method of claim 10, further comprising:

prior to disposing the first and second electrodes, visually identifying a crack in the surface of the component; wherein each of the first and second electrodes is substantially elongated in shape, and wherein disposing the first and second electrodes includes orienting the first and second electrodes such that the crack runs substantially parallel to the electrodes.

20. The method of claim 10, further comprising:

prior to disposing the first and second electrodes, visually identifying a crack in the surface of the component; wherein each of the first and second electrodes is substantially elongated in shape, and wherein disposing the first and second electrodes includes orienting the first and second electrodes such that the crack runs substantially perpendicular to the electrodes.

21. The method of claim 9 wherein placing and passing occurs over a first surface location of component, further comprising:

after placing and passing, placing the interface back into electrical contact with the surface of the component and passing the electric current through the interface and the component again, to melt other tips of a set of other cracks along the surface of the component at a second surface location of the component.

22. The method of claim 21 wherein the first and second surface locations of the component partially overlap.

23. The method of claim 9 wherein the conductive component includes silicon-based material; and wherein passing the electric current through the interface and the component includes sending the electric current through the silicon-based material.

* * * * *